US005813572A

United States Patent [19]

Kolacek

[11] Patent Number: 5,813,572

[45] Date of Patent: Sep. 29, 1998

[54] TOOTHPASTE DISPENSER

[75] Inventor: Ivo Kolacek, Berwyn, Ill.

[73] Assignee: Liblan & Co., Inc., Wheeling, Ill.

[21] Appl. No.: 704,132

[22] Filed: Aug. 28, 1996

[51] Int. Cl.[6] ..... B65D 35/28

[52] U.S. Cl. ..... 222/107; 222/181.3; 222/390

[58] Field of Search ..... 222/103, 326, 222/95, 105, 325, 181.3, 390; 141/361, 360, 351

[56] References Cited

U.S. PATENT DOCUMENTS

| | | | |
|---|---|---|---|
| 2,477,875 | 8/1949 | Hutchason | 222/390 |
| 3,815,787 | 6/1974 | Spies | 222/390 |
| 4,429,811 | 2/1984 | Bakeman | 222/390 |

*Primary Examiner*—Philippe Derakshani
*Attorney, Agent, or Firm*—Hill, Steadman & Simpson

[57] ABSTRACT

A dispenser particularly useful for dispensing toothpaste includes a tubular body closed at one end and having an opening for receiving the neck portion of a toothpaste tube extending therefrom, the dispenser includes an arrangement for squeezing the contents of the tube out the discharge opening including a piston movable in an axial direction of the tubular body. The arrangement includes the piston having a pair of oppositely extending projections that extend through parallel extending slots in the tubular body and are engaged in an internal threaded track of a sleeve received on the tubular body so that rotation of the sleeve will cause the piston to move along the slots and squeeze the contents of the tube towards the discharge opening of the tube.

20 Claims, 3 Drawing Sheets

10
22
46
47
48
17
13
15
40
24
23
30
41
39
50
20
32
11
21
16
33
12
14
26
31
38
34
35
13'
49
V

TOOTHPASTE DISPENSER

BACKGROUND OF THE INVENTION

The present invention is directed to a dispenser and to a dispenser in combination with a bracket for mounting the dispenser on a wall.

The dispensing of a toothpaste from a toothpaste tube becomes difficult when a large portion of the paste has already been removed from the tube. In particular, in order to squeeze the last portion of the paste along the tube toward the end cap requires manipulation with both hands and it, thus, becomes difficult to eject the right amount of toothpaste onto a brush. If a person is suffering from any disability with regard to the use of their hands, this increases the difficulty of dispensing a fixed quantity of toothpaste from the toothpaste tube. Also, persons who are visually impaired may have difficulty in positioning the toothbrush relative to the opening of the tube while attempting to squeeze the content of the tube onto the brush.

SUMMARY OF THE INVENTION

The present invention is directed to a dispenser which allows an easy dispensing of a fixed quantity of material such as toothpaste from the tube, regardless of the amount of paste within the tube. The dispenser, in combination with the wall bracket, allows dispensing of the toothpaste using only a single hand.

To accomplish these goals, the dispenser of the invention comprises a tubular body for receiving a tube of toothpaste having a neck-like discharge opening at one end closed by a removable cap, the tubular body having two ends, with one end being closed by an end member having an opening for receiving the discharge opening of the tube when the tube is inserted into the tubular body and the means for forcing the contents of the tube out of the discharge opening of the tube, said means including a piston member received in the tubular body for movement therein and means for moving the member between a first position adjacent the other end of the two ends and a second position adjacent the one end so that the movement of the piston member from the first position toward the second position progressively flattens the tube to force the contents or paste out of the discharge opening of the tube.

In the preferred embodiment, the hollow body includes an inner sleeve connected to the end member and telescopically receiving a second sleeve having an internal thread. The inner sleeve has two parallel-extending slots, which receive projections on the piston member, which projections extend through the slots and are received in the internal thread of the outer sleeve so that rotation of the outer sleeve relative to the inner sleeve will cause the piston to move along an axial path in the tubular body toward the one end to flatten the tube and to, thus, force the paste from the tube. The threads are selected so that movement of the piston will force a given amount of paste for a quarter turn of the outer sleeve relative to the inner sleeve. A reverse rotation of the sleeves will move the piston in the opposite direction to retract it back to the first position. The tubular body preferably has externally-extending lugs, which allow mounting the dispenser in a wall bracket so that the inner sleeve is anchored in a fixed position and, thus, turning the outer sleeve with one hand enables squeezing a fixed amount of paste from the tube. The wall bracket or mounting preferably includes a holder for the toothbrush to position it adjacent the discharge opening of the tube so that during the step of dispensing, only a single twisting with one hand is necessary.

Other advantages and features of the invention will be readily apparent from the following description of the preferred embodiments, the drawings and claims.

DESCRIPTION OF THE PREFERRED EMBODIMENTS

The principles of the present invention are particularly useful when incorporated in a dispenser, generally indicated at 10, for dispensing the material from a container, such as a tube 11 of toothpaste (FIG. 2), with a neck 12 for a discharge opening.

Figures 1, 2, 3:
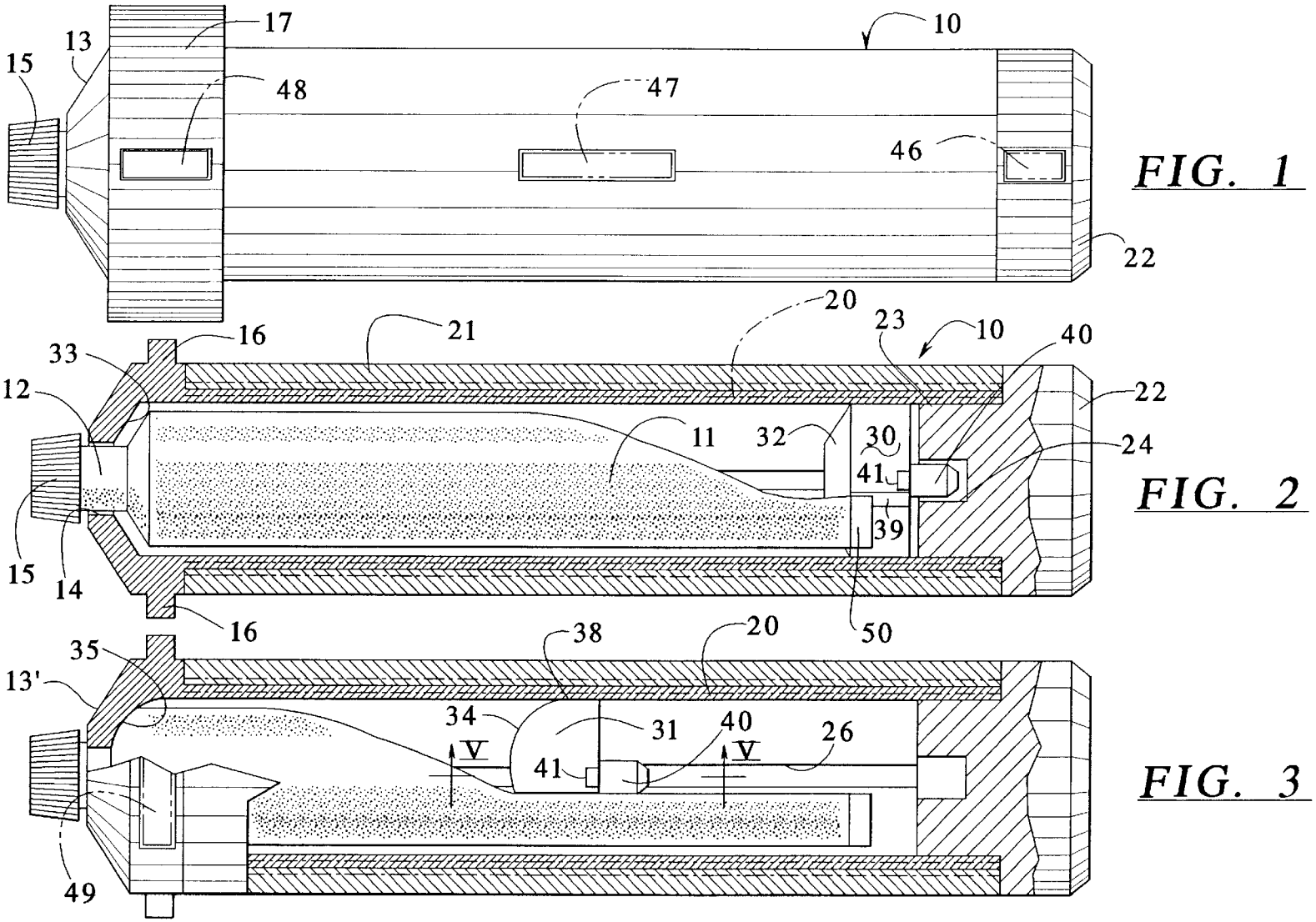
FIG. 1 is a side view of the dispenser according to the present invention.
FIG. 2 is a longitudinal cross sectional view of the dispenser of FIG. 1 with portions in elevation and portions removed for purposes of illustration.
FIG. 3 is a partial cross sectional view of a modification of the dispenser of FIG. 1 with portions in elevation and portions removed for purposes of illustration.
Figure 6:
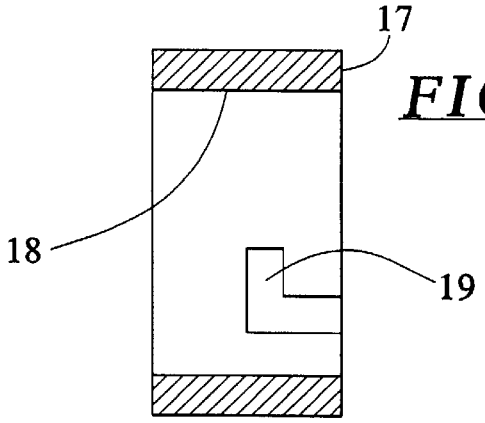
FIG. 6 is a cross sectional view of a fingerband of the dispenser of FIG. 1.

As illustrated in FIGS. 1 and 2, the dispenser 10 has a tubular body member 13, which has a closed end with an aperture 14 at one end, through which the neck 12 of the tube 11 extends and the neck receives the cap 15. The member 13 has a pair of lugs 16, 16 which receive a fingerband 17 that, as illustrated in FIG. 6, has an inner surface 18 provided with two L-shaped grooves 19, which allow insertion of the fingerband onto the lugs with a partial twist to complete an assembly with a bayonet coupling.

As illustrated in FIG. 2, the member 13 has a sleeve portion 20, which receives an outer sleeve 21. At the opposite end, the sleeve portion 20 is connected to an end member or end plug 22, preferably by internal threads receiving threads on a portion 23 of the member 22. The sleeve 21 is free to rotate on the sleeve portion 20 so that it rotates relative to the member 13, the sleeve portion 20 and the end member or plug 22. A piston or flattening member 30 or 31 is disposed within the cavity formed by the sleeve portion 20. The difference between the members 30 and 31 is that the member 30 has a frusto-conical pushing or pressing surface 32, which has a configuration similar to the frusto-conical end surface 33 of the closed end of the body member 13, whereas the member 31 has a dome-shaped pressing surface 34 which matches a dome-shaped end surface 35 in the closed end of body member 13'.

Figure 4:
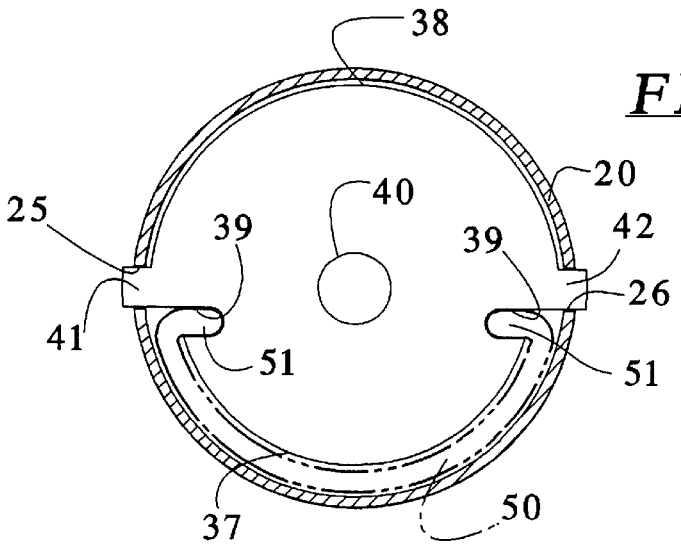
FIG. 4 is an end view of the piston of the dispenser of the present invention with portions removed for purposes of illustration.
Figure 5:
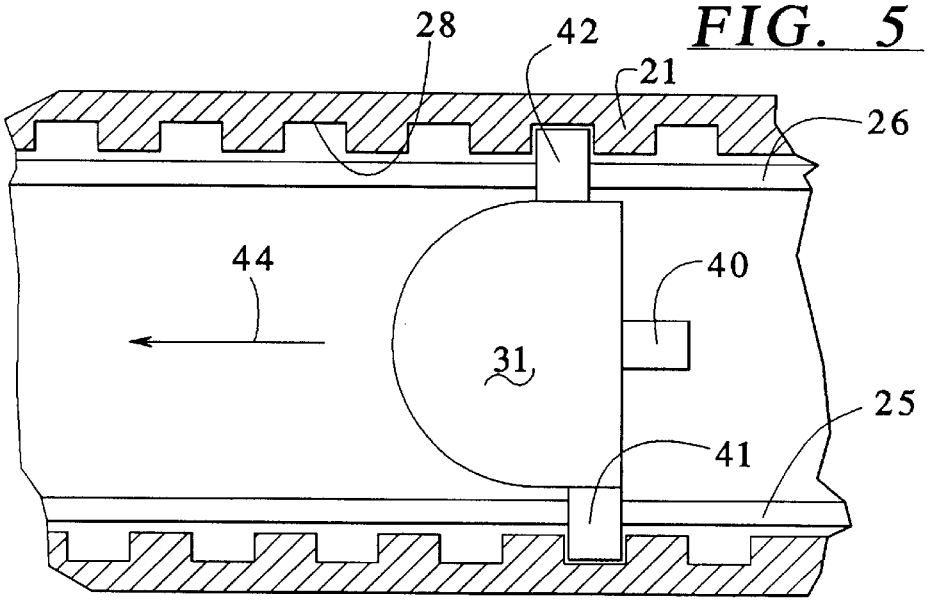
FIG. 5 is a cross sectional view taken along the lines V—V of FIG. 3.

Both pistons 30 and 31 have a rear projection 40 and two oppositely-positioned lugs 41 and 42 (best illustrated in FIGS. 4 and 5). The sleeve portion 20 is provided with two longitudinally-extending slots 25 and 26, with the slot 25 receiving the lug 41 and the slot 26 receiving the lug 42. The outwardly-extending lugs 41 and 42, which are extending through their respective slots 25 and 26, are engaged in a helical track formed by the helical thread 28 of the sleeve 21. Thus, relative rotation of the sleeve 21 on the sleeve 20 will cause the piston, such as 31, to move in an axial direction within the sleeve. By selecting the pitch of the thread 28, the amount of axial movement per rotation can be selected and, as illustrated, is approximately the thickness of the lugs, such as 41 or 42, which are illustrated in FIG. 5 as being axially offset approximately by one-half the thickness of a lug. The two slots, such as 25 and 26, will constrain and prevent rotation of the piston as the sleeve 21 is rotated.

As best illustrated in FIG. 2, the projection 40 is received in a recess or counterbore 24 of the plug 22 during the initial or starting of dispensing of a fresh tube of toothpaste. The flattened end 50 of the standard toothpaste tube is flattened into a semi-circular shape with turned-in sides 51, 51, as shown in FIG. 4, and is wrapped around a lower portion 37 of the piston, such as 31, with the sides 51, 51 received in grooves 39, 39 which are adjacent to the lugs or projection 41, 42. Movement of the piston 31 in the direction of arrow 44 (FIG. 5) will cause the piston to squeeze the content from the flattened end toward the discharge opening of the tube 11. As illustrated in FIG. 4, the piston, whether it is the piston 30 of FIG. 2 or the piston 31 of FIGS. 3–5, has an upper or first portion 38, which is approximately semi-circular and has the projection 41, 42, of a radius larger than a lower or second portion 37 and the two portions 37, 38 are separated by the two grooves 39. The difference in the radius is to accommodate a flattened portion 50 of the toothpaste tube. The radius of the second portion 37 is selected so that with the flattened tube on the surface of portion 37, the piston has a substantially circular configuration that slides in the tubular sleeve portion 20.

Thus, as shown in FIG. 3, the piston moves across the flattened portion and continually acts on that portion of the tube containing the toothpaste. The first portion 38 acts to stabilize the piston in the sleeve portion 20. Finally, once the tube reaches the end adjacent the concave curved surface, such as 35, it can force the remaining portion of the tube to a substantially flat position to enable extracting most of the paste therefrom. If the piston has a conical shape, such as shown in FIG. 2, this coacts with the frusto-conical end surface 33 to cause a flattening of the tube.

The present dispenser has each of its parts, such as the plug 22, the outer nut or sleeve 21, the fingerband 17 and the outer surface of the tubular member 13 are provided with information fields 46, 47, 48 and 49, respectively (See FIG. 1 and 3). These information fields can contain either standard visual information or information in braille for visually impaired persons.

Figures 7, 8, 9:
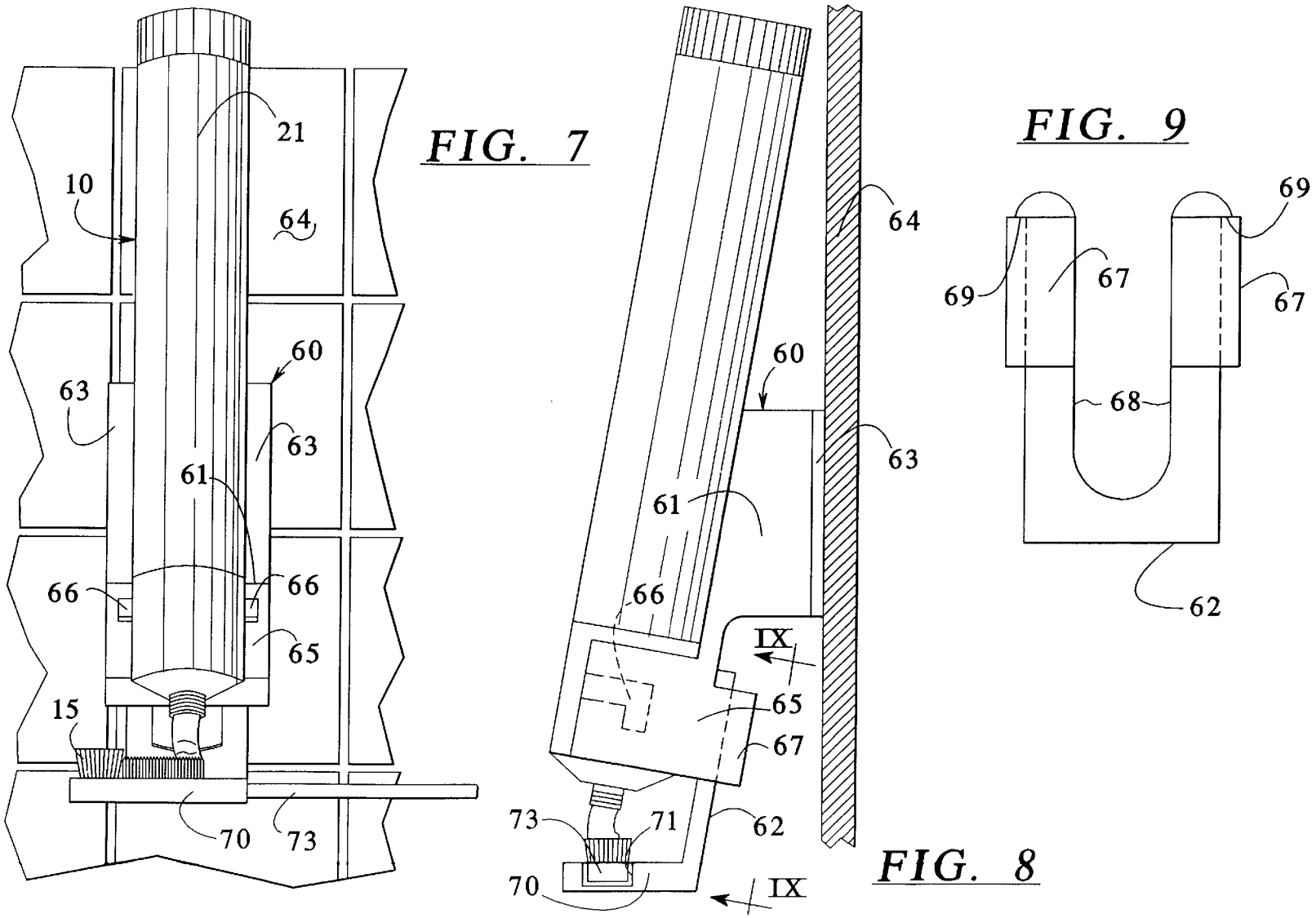
FIG. 7 is a front elevational view of the dispenser on a wall mount with the dispenser dispensing on a toothbrush.
FIG. 8 is a side view of the dispenser on the wall mount of FIG. 7.
FIG. 9 is a partial view taken along the lines VIII—VIIII of FIG. 8.

In order to enable people who are physically handicapped or visually impaired to use this dispenser, the dispenser includes a mounting base generally indicated at 60 and illustrated in FIGS. 7, 8 and 9. The mounting base 60 comprises a wall bracket 61 and a toothbrush holder 62. The wall bracket 61 has a pair of outwardly-extending flanges 63 for mounting the dispenser on a vertical surface 64. The mounting can be accomplished by adhesive, or by passing fasteners or rivets through apertures formed in these flanges 63 and into the wall 64. The bracket 61 includes a portion 65 which, has a concave surface with a semicircular cross-section of a radius of curvature slightly larger than the radius of curvature of the dispenser for receiving the dispenser 10 as illustrated in FIG. 7, and this concave surface has two L-shaped slots 66, 66, which will receive the lugs or projections 16, 16 and allow the dispenser to be inserted and locked in place. As illustrated, the base or member 61 supports the dispenser 10 at an angle to the vertical wall 64. Attached to the base 61 opposite the slots 66 are two L-shaped members 67, which receive legs 68 of the member 62 with a snap-like fit. Each of the legs 68 has a catch 69 to hold the member 62 in the fixed position. In order to remove this member 62 for cleaning, the legs 68 are moved toward each other by squeezing together to release the catches 69 from the members 67.

The member 62, as illustrated, has a portion 70 with a recess or slot 71 which allows receiving the head of a toothbrush 73 and allows it to be moved underneath the discharge opening of the tube. The portion 70 also has a depression or hole for receiving the cap 15.

With the wall mount 60, it is possible for a person to dispense toothpaste by placing the toothbrush 73, with the head in the slot 71, after removing the cap 15. Then, by slowly turning the outer sleeve 21, the piston will cause a squeezing of the tube to cause paste to be ejected onto the bristles. Since one can measure out the amount of paste by the amount of turning of the sleeve 21 relative to the mount 60, one can accurately dispense a quantity of paste on the bristles of the brush 73. This arrangement for dispensing enables a person with one hand to apply paste onto a brush. However, a faster and more accurate way of applying the paste on the brush occurs if one can use both hands.

The dispenser 10 can be loaded with a fresh tube of toothpaste by removing the end cap or plug 22 and inserting the tube into the interior of the sleeve 20 with the discharge opening extending through the bore 14. It may be necessary to remove the cap 15 while inserting the tube in order for the neck 12 of the discharge opening to pass through the bore or opening 14. After the tube has assumed a position, such as illustrated in FIG. 2, the flattened end opposite the discharge opening is flattened by one's finger so that the piston, such as 30 or 31, can be threaded onto the end of the flattened portion 50 of the tube 11 which, as illustrated in FIG. 4, has edge portions or sides 51, 51 received in grooves 39, 39. Then, by rotating the outer sleeve or nut 21 on the inner portion 20, the piston is advanced into engagement with the tube 11. After that, the end plug 22 can be inserted and the dispenser 10 is ready to start dispensing.

As originally designed, the fingerband 17 covers the lugs 16, 16 so that if the dispenser is not used on a wall mounting 60 of FIGS. 7, 8 and 9, one does not injure themselves on the lugs. However, if the dispenser is to be placed in the wall mounting 60, then the fingerband 17 is removed so that the lugs 16, 16 can be received in the respective slots of the wall mount 60. After being placed on the wall mount, then the dispenser is ready to dispense toothpaste onto bristles of a brush.

As mentioned above, various portions are marked by information fields, which may be in braille for the visually impaired users and, as mentioned above, this allows dispensing toothpaste while using only one hand so that those persons who have difficulty in using both hands can apply toothpaste on their brush.

Another advantage of the present invention is that it allows utilizing toothpaste containers of thinner and more pliable materials, such as plastic material, which would reduce the cost of packaging of the paste and reduce waste for recycling empty packages. In fact, since the container can be made of a single plastic, this would greatly increase the recyclability of empty tubes.

Although various minor modifications may be suggested by those versed in the art, it should be understood that I wish to embody within the scope of the patent granted hereon all such modifications as reasonably and properly come within the scope of my contribution to the art.

I claim:

1. A dispenser comprising a tubular body for receiving a tube having a projection at one end with a discharge opening closed by a removable cap, said body having a substantially cylindrical inner surface and two ends with one end being closed by an end member having an opening for receiving the projection when the tube is inserted into the tubular body, means for forcing the contents of the tube out of the discharge opening of the tube, said means including a piston member received in the tubular body for movement therein to squeeze the tube against the portion of the inner surface and means for moving the member between a first position adjacent the other end of the two ends and a second position adjacent the one end so that the movement of the piston member from the first position toward the second position progressively flattens the tube against said portion to force the contents out of the discharge opening of the tube.

2. A dispenser according to claim 1, wherein adjacent the one end, the tubular body has two external projecting lugs.

3. A dispenser according to claim 2, which includes a ring member having two L-shaped slots formed on an inner surface, said slots receiving the external lugs of the tubular body for mounting the ring member thereon.

4. A dispenser according to claim 2, which includes a mounting bracket, said mounting bracket having a curved surface portion for receiving the external surface of the tubular body, said curved surface portion having a pair of L-shaped slots for receiving the lugs to form a connection therewith between the bracket and the dispenser.

5. A dispenser according to claim 4, wherein said bracket has flanges for attaching the bracket to a vertical surface.

6. A dispenser according to claim 4, wherein said bracket includes a second portion having means for holding a toothbrush with the bristles of the brush positioned under the discharge opening of the tube.

7. A dispenser according to claim 6, wherein said second portion is a removable second portion which is connected to said bracket and includes a recess for receiving the cap removed from the discharge opening.

8. A dispenser according to claim 1, wherein the means for moving includes two axially extending slots in the tubular body, a sleeve having a helical track formed by a thread received on the tubular body and rotatable relative thereto, and the piston member having two lugs projecting in opposite directions through the two slots and received in the helical track.

9. A dispenser comprising a tubular body for receiving a tube having a projection at one end with a discharge opening closed by a removable cap, said body having two ends with one end being closed by an end member having an opening for receiving the projection when the tube is inserted into the tubular body, means for forcing the contents of the tube out of the discharge opening of the tube, said means including a piston member received in the tubular body for movement therein and means for moving the member between a first position adjacent the other end of the two ends and a second position adjacent the one end to progressively flatten the tube to force the contents out of the discharge opening of the tube, said means for moving including two axially extending slots in the tubular body, a sleeve having a helical track formed by a thread received on the tubular body and rotatable relative thereto, and the piston member having two lugs projecting in opposite directions through the two slots and received in the helical track, said piston member having a pair of grooves subdividing the periphery of the piston into a first half and second half, said first half having a radius of curvature larger than the second half so that with movement of said piston member, the flattened portion of the tube can move between the second portion and the inner surface of the tubular body.

10. A dispenser according to claim 9, wherein said grooves are of a size to receive turned in edges of the flattened tube.

11. A dispenser according to claim 9, wherein the piston member has a pressing surface facing the closed end of the tubular body having a convexed curvature, said tubular body at said one end having an internal convex curved surface substantially matching the pressing surface of the piston member.

12. A dispenser according to claim 9, wherein the piston member has a pressing surface which is a frustoconical surface facing the closed end of the tubular body and the closed end of the tubular body has an internal tapering surface substantially matching the frustoconical surface of the piston member.

13. A dispenser according to claim 9, wherein the piston member opposite a pressing surface has a surface provided with an axially extending projection and the tubular body has the other end closed by a plug member having a counterbore for receiving the axially extending projection of the piston member.

14. A dispenser comprising a tubular body for receiving a tube having a projection at one end with a discharge opening closed by a removable cap, said body having two ends with one end being closed by an end member having an opening for receiving the projection when the tube is inserted into the tubular body, said tubular body having two external projecting lugs adjacent the one end, means for forcing the contents of the tube out of the discharge opening of the tube, said means including a piston member received in the tubular body for movement therein and means for moving the member between a first position adjacent the other end of the two ends and a second position adjacent the one end to progressively flatten the tube to force the contents out of the discharge opening of the tube, said means for moving including two axially extending slots in the tubular body, a sleeve having a helical track formed by a thread received on the tubular body and rotatable relative thereto, and the piston member having two lugs projecting in opposite directions through the two slots and received in the helical track.

15. A dispenser according to claim 14, which includes a ring member having two L-shaped slots formed on an inner surface, said slots receiving the external lugs of the tubular body for mounting the ring member thereon.

16. A dispenser according to claim 14, which includes a mounting bracket, said mounting bracket having a curved surface portion for receiving the external surface of the tubular body, said curved surface portion having a pair of L-shaped slots for receiving the lugs to form a connection therewith between the bracket and the dispenser.

17. A dispenser according to claim 16, wherein said bracket has flanges for attaching the bracket to a vertical surface.

18. A dispenser according to claim 16, wherein said bracket includes a second portion having means for holding a toothbrush with the bristles of the brush positioned under the discharge opening of the tube.

19. A dispenser according to claim 18, wherein said second portion is a removable second portion which is connected to said bracket.

20. A dispenser according to claim 19, wherein said removable second portion includes a recess for receiving the cap removed from the discharge opening.

* * * * *